US005981084A

United States Patent [19]

Riabkov et al.

[11] Patent Number: 5,981,084

[45] **Date of Patent: *Nov. 9, 1999**

[54] ELECTROLYTIC PROCESS FOR CLEANING ELECTRICALLY CONDUCTING SURFACES AND PRODUCT THEREOF

[75] Inventors: Vitalij M. Riabkov, Moscow; Valerij L. Steblianko, Magnitogorsk, both of Russian Federation

[73] Assignee: Metal Technology, Inc., Mandeville, La.

[ * ] Notice: This patent is subject to a terminal disclaimer.

[21] Appl. No.: 08/935,184

[22] Filed: Sep. 22, 1997

Related U.S. Application Data

[63] Continuation-in-part of application No. 08/706,913, Sep. 3, 1996, abandoned.

[30] Foreign Application Priority Data

Mar. 20, 1996 [RU] Russian Federation ..... 96104583

[51] Int. Cl.[6] ..... C25F 1/00

[52] U.S. Cl. ..... 428/612; 205/705; 205/712; 428/687

[58] Field of Search ..... 205/87, 95, 102, 205/131, 148, 151, 219, 705, 714, 715, 716, 712; 428/612, 687, 935

[56] References Cited

U.S. PATENT DOCUMENTS

| | | | |
|---|---|---|---|
| 3,620,934 | 11/1971 | Endle | 205/87 |
| 3,834,999 | 9/1974 | Hradcovsky et al. | 205/318 |

(List continued on next page.)

FOREIGN PATENT DOCUMENTS

| | | |
|---|---|---|
| 1165271 | 4/1984 | Canada . |
| 0037190 | 10/1981 | European Pat. Off. . |
| 0406417 | 12/1988 | European Pat. Off. . |
| 0657564 | 6/1995 | European Pat. Off. . |
| 892919 | 1/1944 | France . |
| 2561672 | 9/1985 | France . |
| 3725454 | 11/1988 | Germany . |
| 4031234 | 4/1992 | Germany . |
| 08003794 | 1/1996 | Japan . |
| 1244216 | 7/1986 | U.S.S.R. . |
| 1599446 | 10/1990 | U.S.S.R. . |
| 1306337 | 2/1973 | United Kingdom . |
| 1399710 | 2/1975 | United Kingdom . |
| 1436744 | 5/1976 | United Kingdom . |

OTHER PUBLICATIONS

A.V. Timoshenko et al., "The Effect of Silicates in Sodium–Hydroxide Solution . . . by Microarc Oxidation" in *Protection of Metals,* vol. 30, No. 2, 1944, pp. 175–180. No month available.

*Primary Examiner*—Kathryn Gorgos
*Assistant Examiner*—William T. Leader
*Attorney, Agent, or Firm*—Watson Cole Grindle Watson, P.L.L.C.

[57] ABSTRACT

An electrolytic process for cleaning the surface of a workpiece of an electrically conducting material, which process comprises:

i) providing an electrolytic cell with a cathode comprising the surface of the workpiece and an inert anode;

ii) introducing an electrolyte into the zone created between the anode and the cathode by causing it to flow under pressure through at least one opening in the anode and thereby impinge on the surface of the cathode, the surface of the cathode not otherwise being immersed in the electrolyte; and iii) applying a voltage between the anode and the cathode and operating in a regime in which the electrical current decreases or remains substantially constant with increase in the voltage applied between the anode and the cathode, and in a regime in which gas bubbles are present on the surface of the workpiece during treatment.

16 Claims, 6 Drawing Sheets

U.S. PATENT DOCUMENTS

| | | | |
|---|---|---|---|
| 4,033,274 | 7/1977 | Beese | 72/347 |
| 4,046,644 | 9/1977 | Liska | 205/170 |
| 4,304,641 | 12/1981 | Grandia et al. | 205/96 |
| 4,374,719 | 2/1983 | Bakewell et al. | 204/202 |
| 4,405,432 | 9/1983 | Kosowsky | 204/206 |
| 4,508,396 | 4/1985 | Doi et al. | 384/463 |
| 4,529,486 | 7/1985 | Polan | 205/77 |
| 4,684,451 | 8/1987 | Damiron et al. | 205/705 |
| 4,810,343 | 3/1989 | Bonnardel | 204/224 R |
| 4,959,275 | 9/1990 | Iguchi et al. | 428/603 |
| 5,232,563 | 8/1993 | Warfield | 205/766 |
| 5,366,814 | 11/1994 | Yamanishi et al. | 428/607 |
| 5,397,651 | 3/1995 | Wirz | 428/600 |
| 5,700,366 | 12/1997 | Steblianko et al. | 205/87 |

ELECTRODE SEPARATION = 12mm
TEMPERATURE = 30°C
Q = ELECTROLYTE FLOW RATE

ELECTRODE SEPARATION = 12mm
TEMPERATURE = 40°C
Q = ELECTROLYTE FLOW RATE

ELECTRODE SEPARATION = 12mm
TEMPERATURE = 60°C
Q = ELECTROLYTE FLOW RATE

ELECTROLYTIC PROCESS FOR CLEANING ELECTRICALLY CONDUCTING SURFACES AND PRODUCT THEREOF

CROSS-REFERENCE TO RELATED APPLICATION

This application is a Continuation-in-Part of U.S. application Ser. No. 08/706,913 filed Sep. 3, 1996, now abandoned.

BACKGROUND OF INVENTION

The present invention relates to a process for cleaning an electrically conducting surface, such as a metal surface.

Metals, notably steel in its many forms, usually need to be cleaned and/or protected from corrosion before being put to their final use. As produced, steel normally has a film of mill-scale (black oxide) on its surface which is not uniformly adherent and renders the underlying material liable to galvanic corrosion. The mill-scale must therefore be removed before the steel can be painted, coated or metallized (e.g. with zinc). The metal may also have other forms of contamination (known in the industry as "soil") on its surfaces including rust, oil or grease, pigmented drawing compounds, chips and cutting fluid, and polishing and buffing compounds. All of these must normally be removed. Even stainless steel may have an excess of mixed oxide on its surface which needs removal before subsequent use.

Traditional methods of cleaning metal surfaces include acid pickling (which is increasingly unacceptable because of the cost and environmental problems caused by the disposal of the spent acid); abrasive blasting; wet or dry tumbling; brushing; salt-bath descaling; alkaline descaling and acid cleaning. A multi-stage cleaning operation might, for example, involve (i) burning-off or solvent-removal of organic materials, (ii) sand- or shot-blasting to remove mill-scale and rust, and (iii) electrolytic cleaning as a final surface preparation. If the cleaned surface is to be given anti-corrosion protection by metallizing, painting or plastic coating, this must normally be done quickly to prevent renewed surface oxidation. Multi-stage treatment is effective but costly, both in terms of energy consumption and process time. Many of the conventional treatments are also environmentally undesirable.

Electrolytic methods of cleaning metal surfaces are frequently incorporated into processing lines such as those for galvanizing and plating steel strip and sheet. Common coatings include zinc, zinc alloy, tin, copper, nickel and chromium. Stand-alone electrolytic cleaning lines are also used to feed multiple downstream operations. Electrolytic cleaning (or "electro-cleaning") normally involves the use of an alkaline cleaning solution which forms the electrolyte while the workpiece may be either the anode or the cathode of the electrolytic cell, or else the polarity may be alternated. Such processes generally operate at low voltage (typically 3 to 12 Volts) and current densities from 1 to 15 Amps/dm$^2$. Energy consumptions thus range from about 0.01 to 0.5 kWh/m$^2$. Soil removal is effected by the generation of gas bubbles which lift the contaminant from the surface. When the surface of the workpiece is the cathode, the surface may not only be cleaned but also "activated", thereby giving any subsequent coating an improved adhesion. Electrolytic cleaning is not normally practicable for removing heavy scale, and this is done in a separate operation such as acid pickling and/or abrasive-blasting.

Conventional electrolytic cleaning and plating processes operate in a low-voltage regime in which the electrical current increases monotonically with the applied voltage (see FIG. 1 hereinafter at A). Under some conditions, as the voltage is raised, a point is reached at which instability occurs and the current begins to decrease with increasing voltage (see FIG. 1 hereinafter at B). The unstable regime marks the onset of electrical discharges at the surface of one or other of the electrodes. These discharges ("micro-arcs" or "micro-plasmas") occur across any suitable non-conducting layer present on the surface, such as a layer of gas or vapour. This is because the potential gradient in such regions is very high.

PRIOR ART

GB-A-1399710 teaches that a metal surface can be cleaned electrolytically without over-heating and without excessive energy consumption if the process is operated in a regime just beyond the unstable region, the "unstable region" being defined as one in which the current decreases with increasing voltage. By moving to slightly higher voltages, where the current again increases with increasing voltage and a continuous film of gas/vapour is established over the treated surface, effective cleaning is obtained. However, the energy consumption of this process is high (10 to 30 kWh/m$^2$) as compared to the energy consumption for acid pickling (0.4 to 1.8 kWh/m$^2$).

SU-A-1599446 describes a high-voltage electrolytic spark-erosion cleaning process for welding rods which uses extremely high current densities, of the order of 1000 A/dm$^2$, in a phosphoric acid solution.

SU-A-1244216 describes a micro-arc cleaning treatment for machine parts which operates at 100 to 350 V using an anodic treatment. No particular method of electrolyte handling is taught.

Other electrolytic cleaning methods have been described in GB-A-1306337 where a spark-erosion stage is used in combination with a separate chemical or electro-chemical cleaning step to remove oxide scale; in U.S. Pat. No. 5,232,563 where contaminants are removed at low voltages from 1.5 to 2 V from semi-conductor wafers by the production of gas bubbles on the wafer surface which lift off contaminants; in EP-A-0657564, in which it is taught that normal low-voltage electrolytic cleaning is ineffective in removing grease, but that electrolytically oxidisable metals such as aluminum may be successfully degreased under high voltage (micro-arc) conditions by acid anodisation.

The use of jets of electrolyte situated near the electrodes in electrolytic cleaning baths to create high speed turbulent flow in the cleaning zone is taught for example in JP-A-08003797 and DE-A-4031234.

The electrolytic cleaning of radioactively contaminated objects using a single jet of electrolyte without overall immersion of the object, is taught in EP-A-0037190. The cleaned object is anodic and the voltage used is between 30 to 50 V. Short times of treatment of the order of 1 sec are recommended to avoid erosion of the surface and complete removal of oxide is held to be undesirable. Non-immersion is also taught in CA-A-1165271 where the electrolyte is pumped or poured through a box-shaped anode with an array of holes in its base. The purpose of this arrangement is to allow a metal strip to be electro-plated on one side only and specifically to avoid the use of a consumable anode.

DE-A-3715454 describes the cleaning of wires by means of a bipolar electrolytic treatment by passing the wire through a first chamber in which the wire is cathodic and a second chamber in which the wire is anodic. In the second chamber a plasma layer is formed at the anodic surface of the wire by ionisation of a gas layer which contains oxygen. The wire is immersed in the electrolyte throughout its treatment.

EP-A-0406417 describes a continuous process for drawing copper wire from copper rod in which the rod is plasma cleaned before the drawing operation. The "plasmatron" housing is the anode and the wire is also surrounded by an inner co-axial anode in the form of a perforated U-shaped sleeve. In order to initiate plasma production the voltage is maintained at a low but unspecified value, the electrolyte level above the immersed wire is lowered, and the flow-rate decreased in order to stimulate the onset of a discharge at the wire surface.

Whilst low voltage electrolytic cleaning is widely used to prepare metal surfaces for electro-plating or other coating treatments, it cannot handle thick oxide deposits such as mill-scale without an unacceptably high expenditure of energy. Such electrolytic cleaning processes must normally be used, therefore, in conjunction with other cleaning procedures in a multi-stage operation.

We have now developed a particularly efficient metal cleaning process which is able to handle thick oxide scales.

SUMMARY OF THE INVENTION

Accordingly, in one aspect the present invention provides an electrolytic process for cleaning the surface of a workpiece of an electrically conducting material, which process comprises:

i) providing an electrolytic cell with a cathode comprising the surface of the workpiece and an inert anode;

ii) introducing an electrolyte into the zone created between the anode and the cathode by causing it to flow under pressure through one or more holes, channels or apertures in the anode and thereby impinge on the surface of the cathode, the surface of the cathode not otherwise being immersed in the electrolyte; and iii) applying a voltage between the anode and the cathode and operating in a regime in which the electrical current decreases or remains substantially constant with increase in the voltage applied between the anode and the cathode, and in a regime in which discrete gas bubbles are present on the surface of the workpiece during treatment.

DETAILED DESCRIPTION OF THE INVENTION

Figure 1:
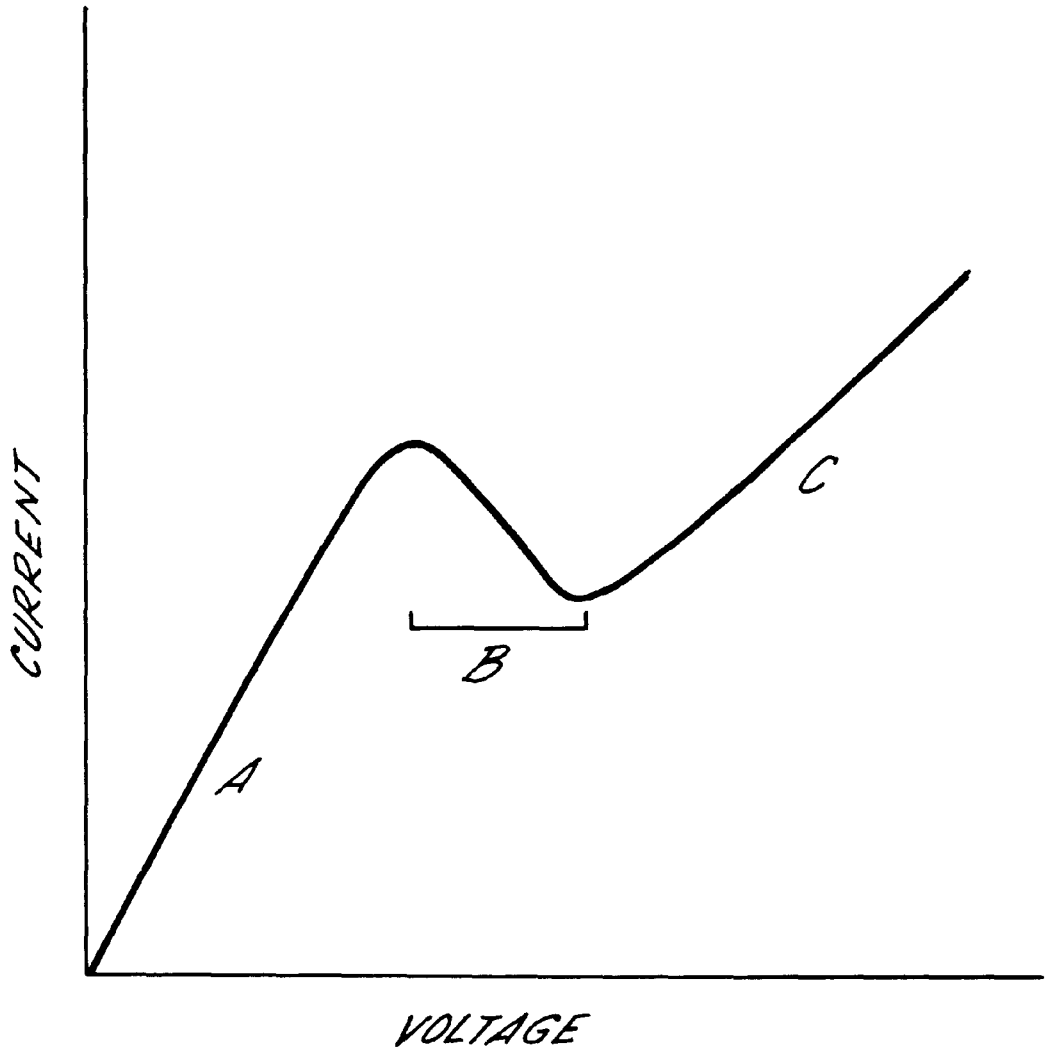
FIG. 1 illustrates schematically the regime of operation where the electrical current decreases, or does not increase with increase in the applied voltage.

By the term "inert" as used herein is meant that no material is transferred from the anode to the workpiece.

In carrying out the method of the present invention the workpiece has a surface which forms the cathode in an electrolytic cell. The anode comprises an inert conducting material, such as carbon or a high melting point metal. The process is operated in a regime in which the electrical current decreases, or at least does not increase significantly, with an increase in voltage applied between the anode and the cathode. The process of the present invention may be carried out as a continuous or semi-continuous process by arranging for relative movement to take place of the workpiece in relation to the anode or anodes. Alternatively, stationary articles may be treated according to the process of the invention. The electrolyte is introduced into the working zone between the anode and the cathode by causing it to flow under pressure through at least one hole, channel or aperture in the anode, whereby it impinges on the cathode (the surface under treatment).

Each of these features are described in more detail below.

Cathodic Arrangement of the Surface to be Treated

The workpiece can be of any shape or form including sheet, plate, tube, pipe, wire or rod. The surface of the workpiece which is treated in accordance with the process of the invention is that of the cathode. For safety reasons, the cathodic workpiece is normally earthed. This does not rule out the use of alternating polarity. The applied positive voltage at the anode may be pulsed.

The cathodic processes involved at the treated surface are complex and may include among other effects; chemical reduction of oxide; cavitation; destruction of crystalline order by shock waves; and ion implantation.

Composition of the Anode

The anode comprises an inert conducting material, such as carbon for example carbon in the form of one or more blocks, rods, sheets, wires or fibres, or as a graphite coating on a suitable substrate. Under certain process conditions which are not particularly aggressive (modest treatment times and severity of treatment), stainless steel anodes can also be considered to be inert, since they do not erode and material therefrom is not transferred to the workpiece. A variety of other high-melting point and refractory metals may also be used as inert anodes provided that under the processing conditions they do not significantly erode and do not transfer metal to the workpiece.

Physical Form of the Anode

The anode will generally be of such a shape that its surface lies at a substantially constant distance (the "working distance") from the cathode (the surface to be treated). This distance may typically be about 12 mm. Thus if the treated surface is flat, the anode surface will generally also be flat, but if the former is curved the anode may also advantageously be curved to maintain a substantially constant distance. Non-conducting guides or separators may also be used to maintain the working distance in cases where the working distance cannot be readily controlled by other means.

The anode may be of any convenient size, although large effective anode areas may be better obtained by using a plurality of smaller anodes since this facilitates the flow of electrolyte and debris away from the working area and improves heat dissipation.

A key aspect of the invention is that the electrolyte is introduced into the working area by flow under pressure through the anode which is provided with at least one and preferably a plurality of holes, channels or apertures for this purpose. Such holes may conveniently be of the order of 1–2 mm in diameter and 1–2 mm apart.

The effect of this electrolyte handling method is that the surface of the workpiece which is to be treated is bombarded with streams, sprays or jets of electrolyte. The electrolyte, together with any debris generated by the cleaning action, runs off the workpiece and can be collected, filtered, cooled and recirculated as necessary. Flow-through arrangements are commonly used in electroplating (see U.S. Pat. Nos. 4,405,432 and 4,529,486; and CA 1165271), but have not previously been used in the micro-plasma regime.

Any physical form of the anode may be used which permits the electrolyte to be handled as described above.

Optionally, an electrically insulated screen containing finer holes than the anode itself may be interposed between the anode and the workpiece. This screen serves to refine the jet or jets emerging from the anode into finer jets which then impinge on the workpiece.

Regime of Operation

The process is operated in a regime in which the electrical current decreases, or at least does not increase significantly, with an increase in voltage applied between the anode and the cathode. This is region B in FIG. 1 and was previously referred to as the "unstable region" in UK-A-1399710. This regime is one in which discrete bubbles of gas and vapour are present on the surface of the workpiece which is being treated, rather than a continuous gas film or layer. This distinguishes the regime employed from that employed in UK-A-1399710 which clearly teaches that the gas film must be continuous.

Successful establishment of the desired "bubble" regime depends upon finding an appropriate combination of a number of variables, including the voltage (or the power consumption), the inter-electrode separation, the electrolyte flow rate and the electrolyte temperature and external influences as known in the art such as ultrasonic irradiation.

Ranges of Variables

The ranges of the variables within which useful results can be obtained are as follows:

Voltage

The range of voltage employed is that denoted by B in FIG. 1 and within which the current decreases or remains substantially constant with increasing voltage. The actual numerical voltages depend upon several variables, but will generally be in the range of from 10 V to 250 V, according to conditions. The onset of the unstable region, and thus the lower end of the usable voltage range (denoted $V_{cr}$), can be represented by an equation of the form;

$$V_{cr}=n\ (l/d)(\lambda/\alpha\sigma_H)^{0.5}$$

where n is a numerical constant l is the inter-electrode distance d is the diameter of the gas/vapour bubbles on the surface $\lambda$ is the electrolyte heat transfer coefficient $\alpha$ is the temperature coefficient of heat transmission $\sigma_H$ is the initial specific electroconductivity of the electrolyte This equation demonstrates how the critical voltage for the onset of instability depends upon certain of the variables of the system. For a given electrolyte it can be evaluated, but only if n and d are known, so that it does not allow a prediction of critical voltage ab initio. It does, however, show how the critical voltage depends on the inter-electrode distance and the properties of the electrolyte solution.

Inter-electrode Separation

The anode-to-cathode separation, or the working distance, is generally within the range of from 3 to 30 mm, preferably within the range of from 5 to 20 mm.

Electrolyte Flow Rate

The flow rates may vary quite widely, between 0.02 and 0.2 litres per minute per square centimetre of anode ($1/min.cm^2$). The flow channels through which the electrolyte enters the working region between the anode and the workpiece are preferably arranged to provide a uniform flow field within this region. Additional flow of electrolyte may be promoted by jets or sprays placed in the vicinity of the anode and workpiece, as is known in the art, so that some (but not all) of the electrolyte does not pass through the anode itself.

Electrolyte Temperature

The electrolyte temperature also have a significant effect upon the attainment of the desired "bubble" regime. Temperatures in the range of from 10° C. to 95° C. can be usefully employed. It will be understood that appropriate means may be provided in order to heat or cool the electrolyte and thus maintain it at the desired operating temperature.

Electrolyte Composition

The electrolyte composition comprises an electrically conducting aqueous solution which does not react chemically with any of the materials it contacts, such as a solution of sodium carbonate, potassium carbonate, sodium chloride, sodium nitrate or other such salt. The solute may conveniently be present at a concentration of 8% to 12% though this is by way of example only and does not limit the choice of concentration. Optionally, the electrolyte may include as either one component or the sole component, a soluble salt of a suitable metal. In this case, the metal becomes coated onto the workpiece during the cleaning process. The concentration of the metal salt, which may for example conveniently be 30%, has to be maintained by addition as it is consumed.

Suitable Combination of Variables

Figure 2A:
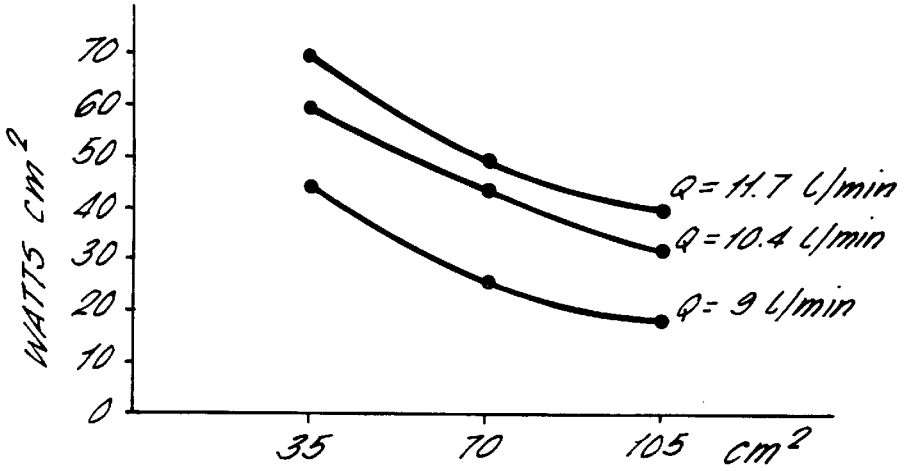
FIGS. 2*a*, 2*b* and 2*c* illustrate operating parameters where the desired operating conditions are achieved.
Figure 2B:
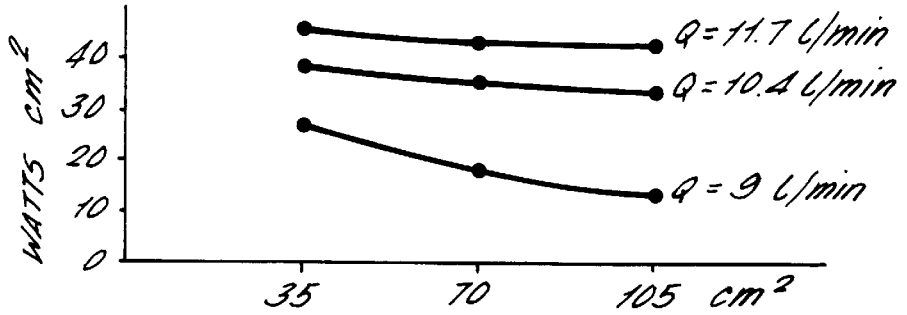
Figure 2C:
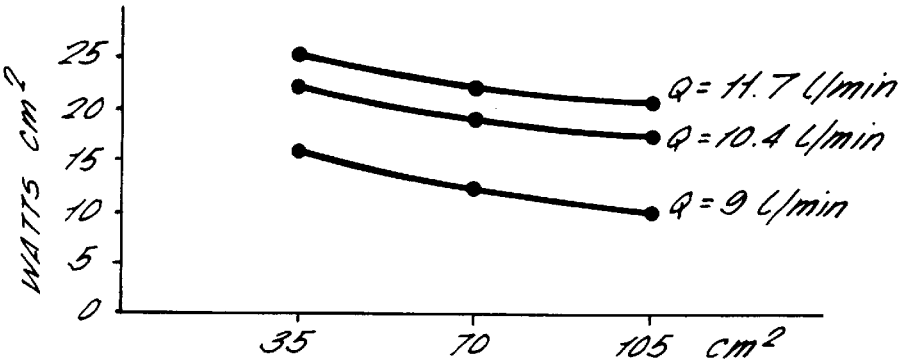

It should be clearly understood that the required "bubble" regime cannot be obtained with any arbitrary combination of the variables discussed above. The desired regime is obtained only when a suitable combination of these variables is selected. One such suitable set of values can be represented by the curves reproduced in FIGS. 2*a*, 2*b* and 2*c* which show, by way of example only, some combinations of the variables for which the desired regime is established, using a 10% sodium carbonate solution. Once the anode area, working distance, electrolyte flow rate and electrolyte temperature have been chosen and set, the voltage is increased while measuring the current until the wattage (voltage×current) reaches the levels given in FIGS. 2*a*, 2*b* and 2*c*. It will be understood by those skilled in the art that other combinations of variables not specified in FIGS. 2*a*, 2*b* and 2*c* may be used to provide the "bubble" regime with satisfactory results being obtained.

The process of the present invention may be used to treat the surface of a workpiece of any desired shape or configuration. In particular, the process may be used to treat a metal in sheet form, or to treat the inside or outside of a steel pipe, or to treat the surface of a free-standing object.

In most known electrolytic cleaning methods it is necessary to immerse the surface of the workpiece which is to be treated in the electrolyte. We have found that there is a large and surprising decrease in energy consumption (compared with the immersed case) when the process of the invention is carried out without the treated surface and anode being immersed in the electrolyte.

The process of the present invention is environmentally friendly and energy efficient as compared to the conventional processes.

The use of the process of the present invention results in a unique surface finish on the surface of the workpiece. This surface finish is characterized by the presence on the surface of numerous small quasi-spherical globules of the metal from which the workpiece is formed. These globules are referred to as quasi-spherical because although they originate as spherical droplets of molten metal, they become oblate or otherwise distorted on deposition and fusing with the substrate. These globules are fused to the surface and thus form an integral part of the surface profile. These globules result from the action of the plasma upon a layer of molten metal from which the workpiece is formed. The diameter of the globules is typically from 1 to 50 micrometres.

The advantage of this profile, which also contains craters caused by the expulsion of molten metal, is that it provides; (1) an efficient mechanical key which can lead to superior adhesion of any subsequently applied coating (for example, of plastic, ceramic or paint) when compared to a conventionally cleaned surface using, for example, grit blasting, of a similar 'anchor profile' (the anchor profile is the average peak-to-valley height of the surface profile); (2) a uniform micro-rough surface finish having non-reflecting and high-friction characteristics which may be desirable in certain applications.

The process of the invention offers economic advantages over the existing cleaning/coating processes. A further feature is that operation of the process of the invention without immersion, by jetting or spraying the electrolyte through channels, holes or apertures in the anode, so that the electrolyte impinges on the surface to be treated, leads to a large reduction in energy consumption relative to operation with immersion, providing further commercial advantage. Operation without immersion also frees the process from the constraints imposed by the need to contain the electrolyte and permits the in-situ treatment of free-standing objects of various shapes.

The process of the present invention is further described with reference to FIGS. 3 to 7 of the accompanying drawings.

Figure 3:
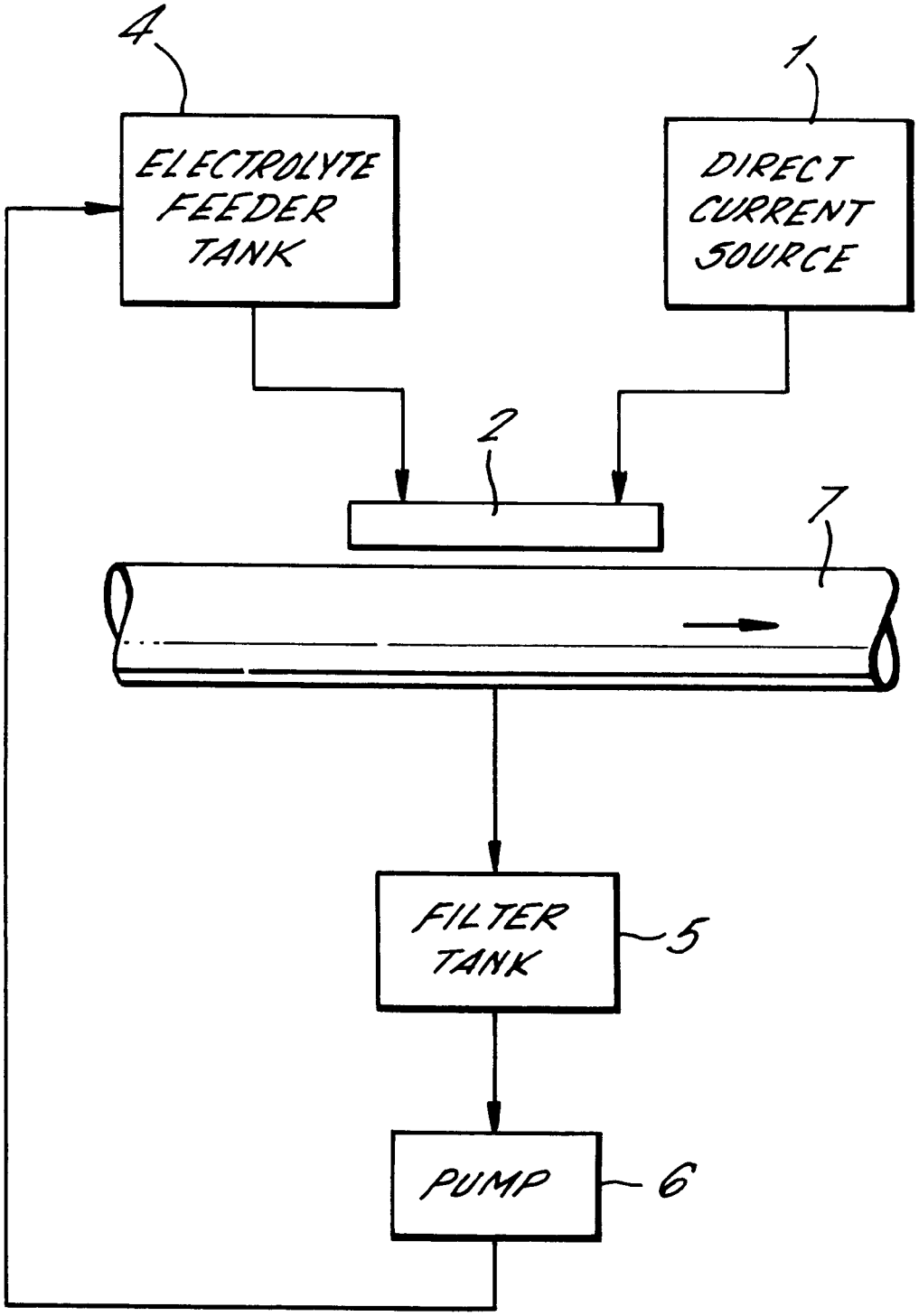
FIG. 3 illustrates schematically the process of the present invention.
Figure 4:
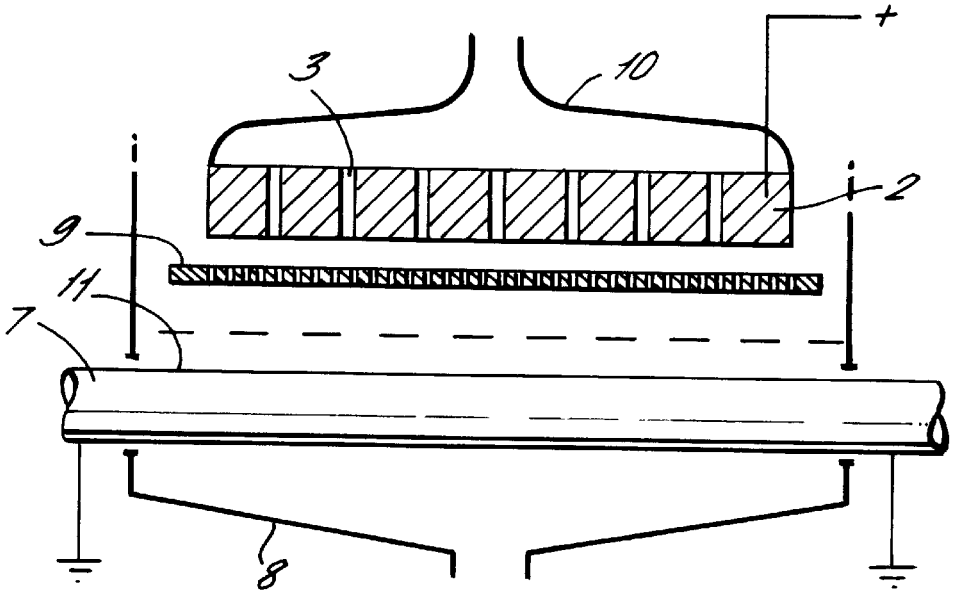
FIG. 4 illustrates schematically an apparatus for carrying out the cleaning process of the invention on one side of an object.

Referring to these drawings, an apparatus for implementing the process of the present invention is schematically illustrated in FIGS. 3 and 4. A direct current source 1 has its positive pole connected to anode 2, which has channels 3 provided therein through which an electrolyte from feeder tank 4 is pumped. The workpiece 7 is connected as the cathode in the apparatus and optionally earthed. The electrolyte from feeder tank 4 may be pumped via a distributor 10 to the anode 2 in order to ensure an even flow of electrolyte through the channels 3 in the anode. An electrically insulated screen 9, which has finer apertures than the channels 3 in the anode, is placed between the anode and the workpiece 7 in order to cause the electrolyte sprayed from the anode channels 3 to break up into finer sprays.

As shown schematically in FIG. 3, the apparatus is provided with a filter tank 5 for separating debris from the electrolyte, and a pump 6 to circulate the filtered electrolyte back to the electrolyte feed tank. Also as shown in FIG. 3, it is envisaged that the workpiece 7 will pass through a working chamber 8, which is constructed in a manner such that longitudinal movement of the workpiece through the chamber can take place. Chamber 8 is also supplied with means to direct the flow of electrolyte to the filter block 5.

Figure 5:
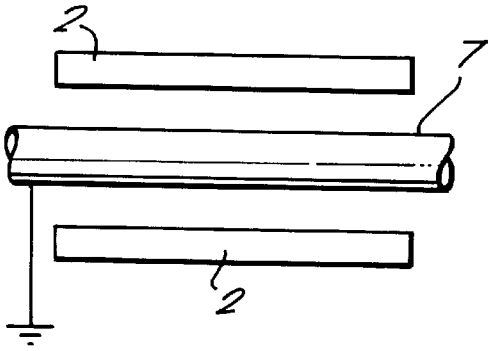
FIG. 5 illustrates schematically an apparatus for carrying out the cleaning process of the invention for the cleaning of both sides of an object.

FIG. 5 illustrates schematically a part of an apparatus for cleaning both sides of a workpiece 7 in which two anodes 2 are placed on either side of the workpiece 7 and are both equidistantly spaced from the workpiece.

Figure 6:
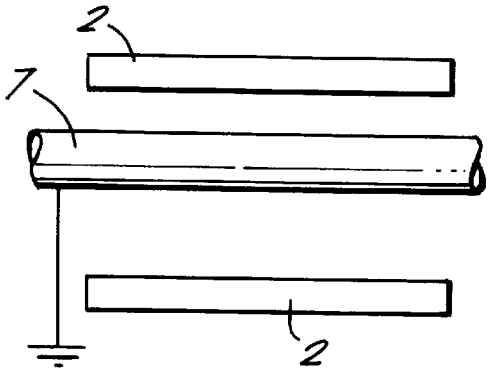
FIG. 6 illustrates schematically an apparatus for carrying out the process of the invention for the cleaning of the two sides of an object at different rates.

FIG. 6 illustrated schematically a part of an apparatus for cleaning the two sides of a workpiece 7. As shown, the two anodes 2 are spaced at different distances from the surfaces of the workpiece 7, thus giving rise to different rates of cleaning on the two surfaces. Alternatively, the two anodes may be of different lengths (not shown) causing the time of treatment of a moving workpiece to differ on the two sides.

Figure 7:
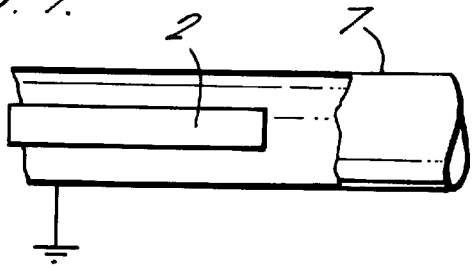
FIG. 7 illustrates schematically an installation for cleaning the inner surface of a pipe.

FIG. 7 illustrates schematically a part of an apparatus for cleaning the inside surface of a pipe which forms the workpiece 7. In this arrangement the anode 2 is positioned within the pipe with appropriate arrangements being provided for the supply of the electrolyte to the anode.

In carrying out the process of the present invention the conditions are so chosen that discrete bubbles of gas and/or vapour are formed on the surface 11 of the workpiece 7. Electrical discharge through the bubbles of gas or vapour formed on the surface cause impurities to be removed from the surface during the processing and those products are removed by the electrolyte flow and filtered by filter block 5.

The present invention will be further described with reference to the following Examples.

EXAMPLE 1

A hot-rolled steel strip having a 5 micrometre layer of mill-scale (black oxide) on its surface was treated according to the method of the invention using a carbon anode. The anode was formed by machining grooves in a graphite plate, in two directions at right angles to give a working surface having rectangular studs to increase surface area. The holes for electrolyte flow were 2mm in diameter and were formed through both the studs and the thinned regions of the plate. The workpiece was held stationary and was not immersed in the electrolyte. The parameters employed were as follows.

Electrolyte: 10% by weight aqueous solution of sodium carbonate
Voltage: 120 V
Electrode separation: 12 mm
Area of anode: 100 $cm^2$
Area treated: 80 $cm^2$
Electrolyte flow rate: 9 1/min total
Electrolyte temp.: 60 degC.

After a cleaning time of 15 seconds and a specific energy consumption of 0.42 $kWh/m^2$, a clean grey metal surface was obtained which showed no sign of oxide either visually or when examined using a scanning electron microscope using dispersive X-ray analysis. The surface topography was deeply pitted on a microscopical scale, providing the potential for keying to any subsequent coating.

EXAMPLE 2

The procedure of Example 1 was repeated but using a steel strip with a 15 micrometre thick layer of mill-scale. The time for cleaning was 30 seconds and the specific energy consumption was 0.84 $kWh/m^2$.

EXAMPLE 3 COMPARATIVE

The procedures of Examples 1 and 2 were repeated with the workpiece immersed in the electrolyte to a depth of 5 mm. The specific energy consumptions required for complete cleaning were as follows;

5 micrometres of mill-scale 3.36 kWh/$m^2$ 15 micrometres of mill-scale 6.83 kWh/$m^2$ It is seen that immersing the workpiece has the effect of raising the energy consumption by a factor of about 8, thereby greatly increasing the energy cost.

EXAMPLE 4

The procedure of Example 1 was repeated using a steel strip without mill-scale, but having a layer of rust and general soil on its surface. Complete cleaning was obtained in 2 seconds or less at a specific energy consumption of 0.06 kWh/$M^2$.

EXAMPLE 5

The general procedure of Example 1 was repeated using a stainless steel anode with an array of holes through which all of the electrolyte passed using the following parameters for operation:

Anode area: 40 $cm^2$

Anode type: Stainless steel (70 mm diameter with a 5×5 array of 2 mm holes)

Voltage: 190 V to 230 V

Current Density: 0.33 amps/$cm^2$

Power Density: 63 Watts/$cm^2$

Electrode Separation: 10 mm

Electrolyte: 10% sodium carbonate

Electrolyte flow: 3 litres/min per 100 $cm^2$ of anode are

The electrolyte temperature was 75° C., rising to 85° C. during operation. The cleaning time was for a period of 45 seconds in total, with constant movement, which was equivalent to approximately 17 seconds cleaning time to clean an area equivalent to that of the anode. After the cleaning the surface was a white-metal surface with a micro-roughness such that the surface was not reflective to light.

EXAMPLE 6

Figure 8A:
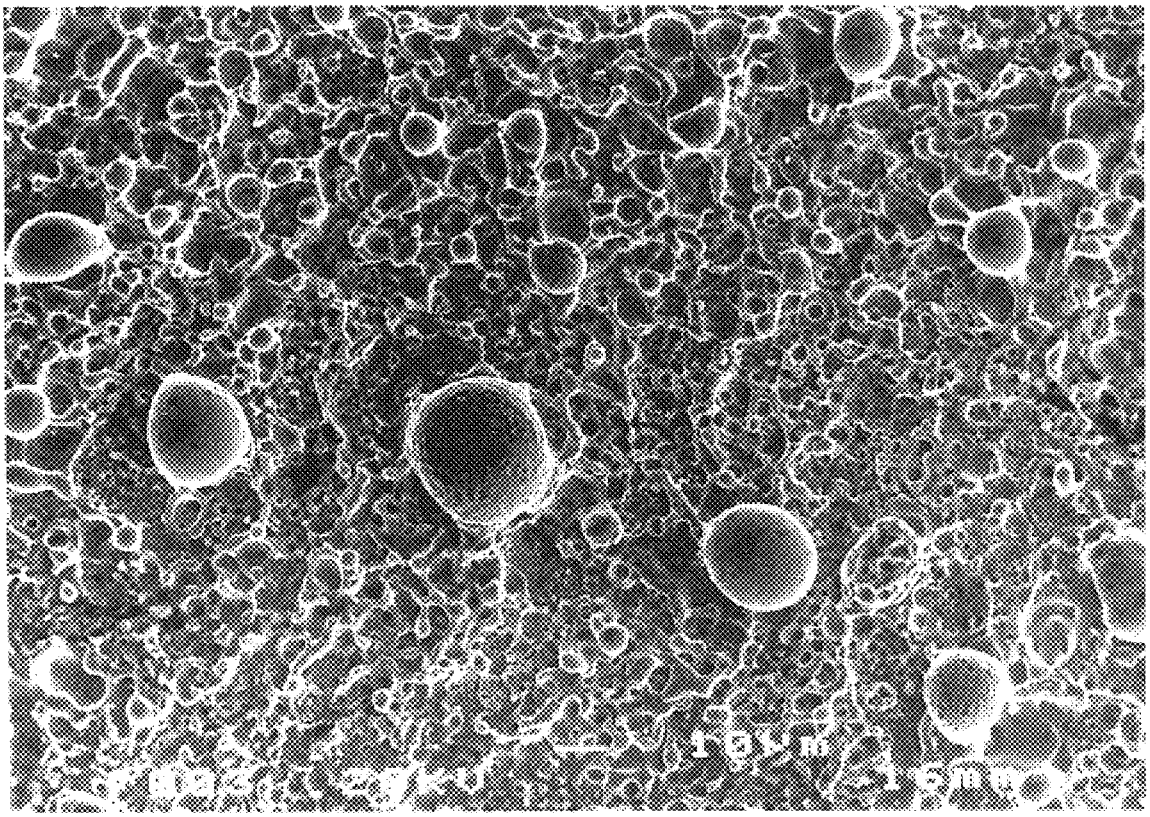
FIG. 8(*a*) is an electron micrograph of the surface of the workpiece according to Example 5.
FIG. 8*b* is an electron micrograph of a cross-section of the surface of the workpiece according to Example 5.
Figure 8B:
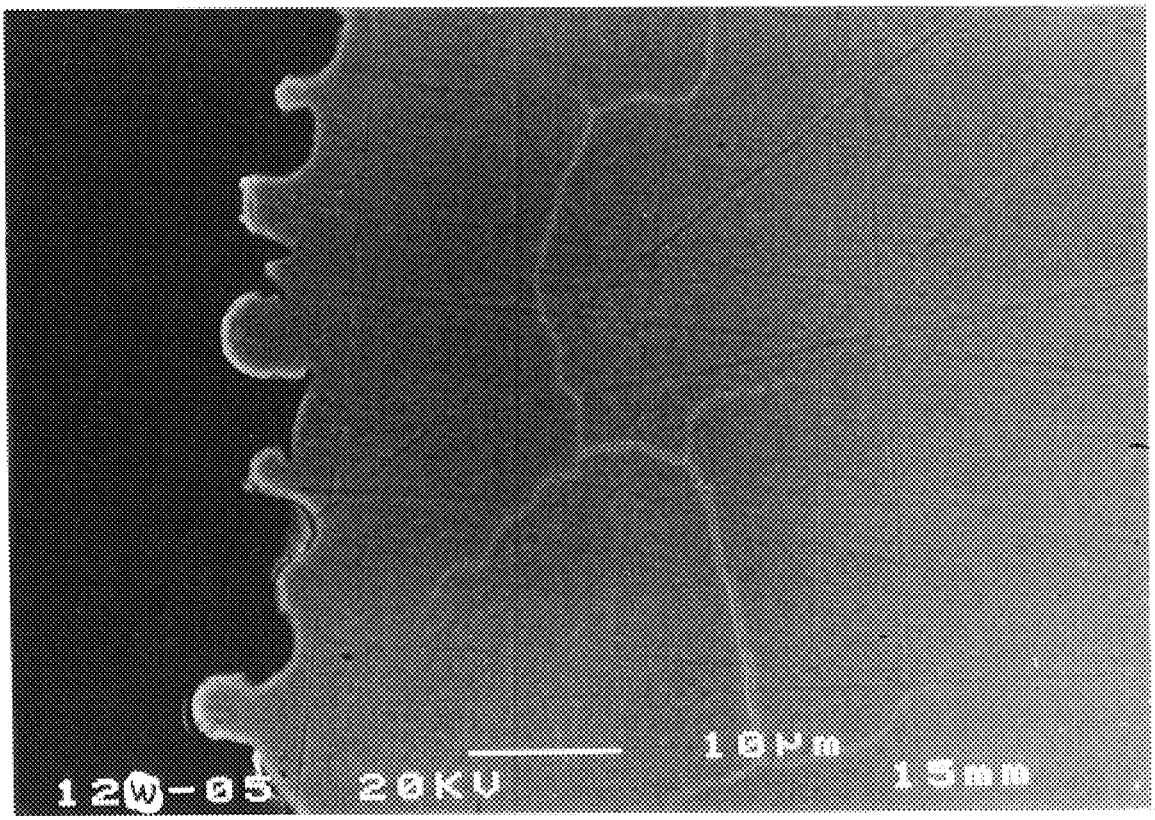

Electron micrographs were taken of the surface of the workpiece cleaned according to the procedure of Example 5. FIG. 8(*a*) of the accompanying drawings depicts the surface of the workpiece at a magnification shown by the datum line on the micrograph. The electron micrograph clearly illustrates the presence of droplets of steel on the surface of the workpiece. FIG. 8(*b*) shows a cross-sectional profile of the same surface, where again the magnification is indicated by the datum line on the micrograph.

We claim:

1. An electrolytic process for cleaning the surface of a workpiece of an electrically conducting material, which process comprises:

i) providing an electrolytic cell with a cathode comprising the surface of the workpiece and an inert anode;

ii) introducing an electrolyte into the zone created between the anode and the cathode by causing it to flow under pressure through one or more holes, channels or apertures in the anode and thereby impinge on the surface of the cathode, the surface of the cathode not otherwise being immersed in the electrolyte; and iii) applying a voltage between the anode and the cathode and operating in a regime in which the electrical current decreases or remains substantially constant with increase in the voltage applied between the anode and the cathode, and in a regime in which discrete gas bubbles are present on the surface of the workpiece during treatment.

2. A process as claimed in claim 1 wherein the workpiece has a surface selected from the group consisting of a single metal and an alloy of two or more metals.

3. A process as claimed in claim 1 wherein the anode is made from a material selected from the group consisting of carbon and stainless steel.

4. A process as claimed in claim 3 wherein the anode is a carbon anode which is selected from the group consisting of at least one block, rod, sheet, wire and a graphite coating on a substrate.

5. A process as claimed in claim 3 wherein the anode is a carbon anode which comprises carbon fibres.

6. A process as claimed in claim 1 wherein the anode has a plurality of holes which extend through the anode to a working face thereof.

7. A process as claimed in claim 1 wherein the anode has a plurality of channels which extend through the a nod e to a working face thereof.

8. A process as claimed in claim 1 wherein the anode has a plurality of apertures which extend through the anode to a working face thereof.

9. A process as claimed in claim 1 wherein the electrolyte emerges from at least one opening in the anode as a plurality of jets and wherein an electrically insulated screen is positioned in the electrolytic cell adjacent the anode in order to refine the jets of electrolyte emerging from the anode into finer jets which impinge upon the cathode.

10. A process as claimed in claim 1 wherein a plurality of anodes are used.

11. A process as claimed in claim 10 wherein at least one anode is disposed on one side of a workpiece to be treated and at least one anode is disposed on an opposite side of the workpiece to be treated, whereby the opposite sides of the workpiece are cleaned.

12. A process as claimed in claim 11 wherein the workpiece is in a form selected from the group consisting of a metal strip, a metal sheet and a metal slab.

13. A process as claimed in claim 1 wherein the workpiece is a pipe.

14. A process as claimed in claim 1 wherein the workpiece is made from stainless steel.

15. A process as claimed in claim 1 wherein the surface of the workpiece moves relative to the anode during the treatment.

16. A metal workpiece which has been cleaned by a process as claimed in claim 1, wherein the metal workpiece has a surface profile which is characterized by the presence on the surface and integral therewith of quasi-spherical droplets of the metal of the workpiece, said droplets having an average diameter in the range of 1 to 50 micrometers.

* * * * *